US005692332A

United States Patent [19]

Bracken

[11] Patent Number: 5,692,332

[45] **Date of Patent: *Dec. 2, 1997**

[54] GARMENT INDICIA STRIP

[75] Inventor: Frank D. Bracken, Dallas, Tex.

[73] Assignee: Haggar Clothing Co., Dallas, Tex.

[21] Appl. No.: 710,492

[22] Filed: Sep. 18, 1996

[ * ] Notice: The term of this patent shall not extend beyond the expiration date of Pat. No. 5,343,648.

Related U.S. Application Data

[63] Continuation of Ser. No. 472,733, Jun. 7, 1995, Pat. No. 5,561,932, which is a continuation of Ser. No. 49,949, Apr. 20, 1993, abandoned, which is a continuation of Ser. No. 643,769, Jan. 18, 1991, Pat. No. 5,343,548, which is a continuation of Ser. No. 522,220, May 10, 1990, abandoned, which is a continuation of Ser. No. 409,765, Sep. 20, 1989, abandoned, which is a continuation of Ser. No. 223,438, Jul. 22, 1988, abandoned.

[51] Int. Cl.[6] ..... G09F 3/10

[52] U.S. Cl. ..... 40/638; 40/661.04; 283/70

[58] Field of Search ..... 40/299, 630, 638, 40/661.04, 661.09; 283/70, 81

[56] References Cited

U.S. PATENT DOCUMENTS

| | | | |
|---|---|---|---|
| 2,739,399 | 3/1956 | Henson | 40/299 |
| 3,350,799 | 11/1967 | Japs | 40/299 |
| 5,343,648 | 9/1994 | Bracken | 40/299 X |
| 5,561,932 | 10/1996 | Bracken | 40/638 |

*Primary Examiner*—Brian K. Green
*Attorney, Agent, or Firm*—Sidley & Austin

[57] ABSTRACT

A garment indicia strip and method for size labeling a garment. A strip of flexible material has indicia repeatedly printed along a first major surface thereof. The indica are printed using symbols having a height no greater than the width of an edge of the garment. A second major surface of the strip has a pressure sensitive adhesive material bonded thereto. In use, the second surface of the strip is affixed to a garment at a predetermined position whereby sizing information of the garment can be determined by reading the strip when the garment is folded.

7 Claims, 1 Drawing Sheet

FIG. 1
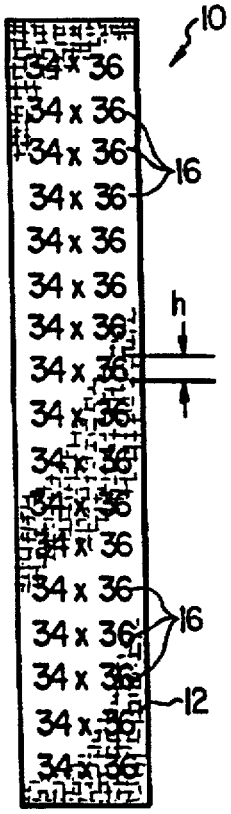
FIG. 2
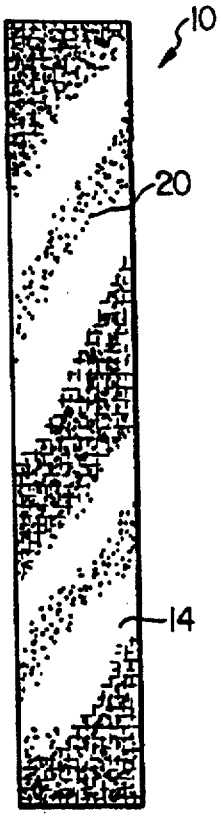
FIG. 3
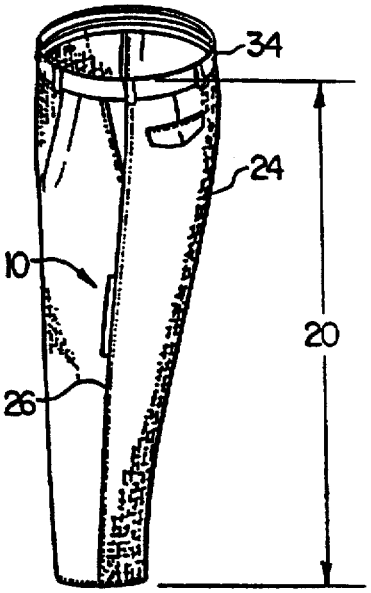
FIG. 4
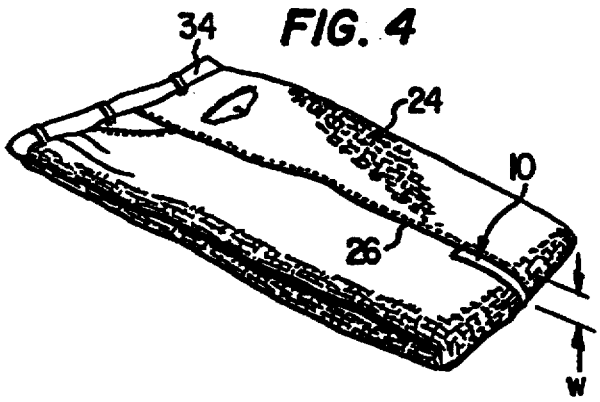
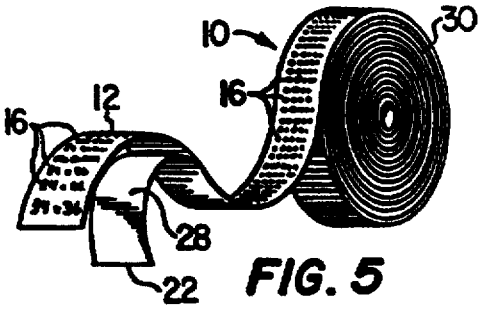
FIG. 5

GARMENT INDICIA STRIP

This is a continuation of U.S. patent application Ser. No. 08/472,733, filed Jun. 7, 1995 now U.S. Pat. No. 5,561,932, which is a continuation of U.S. patent application Ser. No. 08/049,949 filed Apr. 20, 1993, now abandoned, which is a continuation of application Ser. No. 07/643,769 filed Jan. 18, 1991, now U.S. Pat. No. 5,343,648, which is a continuation of application Ser. No. 522,220 filed May 10, 1990, now abandoned, which is a continuation of application Ser. No. 409,765 filed Sep. 20, 1989, now abandoned, which is a continuation of application Ser. No. 223,438 filed Jul. 22, 1988, now abandoned.

TECHNICAL FIELD

This invention relates to garment indicia in the nature of tags, labels, or the like for identification of garment information and a method for using such indicia on folded garments.

BACKGROUND ART

Labels and hangtags are well known for the general purpose of identifying various features of garments. However, such labels and hangtags are commonly affixed to the garment in such a manner and location that the information appearing thereon, and even the label or hangtag itself, is usually hidden when the garments are folded and stacked for storage or display.

Prior inventions have attempted to overcome the shortcomings of commonly used labels and hangtags. For example, U.S. Pat. No. 2,739,399, to Henson, issued Mar. 27, 1956, shows a marking device having a stub portion which may be sewn to a seam of a garment and a tab integral with and extending substantially perpendicularly from the stub portion so as to extend beyond an edge or fold of the garment. Such marking devices have also proven to be unsatisfactory. It is desirable to have a garment indicia strip which will permit a manufacturer or retailer to fold the garment in a plurality of ways for storage or display while maintaining the visibility and legibility of the garment indicia strip. The garment indicia strip should also be flush to the surface of the garment in order to avoid inadvertent tearing or removal of the strip from the garment.

SUMMARY OF THE INVENTION

The garment indicia strip of the present invention is suitable for use with any type of garment or article which may be folded and stacked for storage or display.

The indicia strip of the present invention has a front surface upon which garment indicia are repeatedly printed. A pressure sensitive adhesive is mounted to the rear surface of said strip such that the strip may be removably adhered to a garment.

In use, the garment indicia strip of the present invention can be placed at any point on a garment at which the garment will be folded during storage or display thereof. For example, when the garment indicia strip is used with a pair of pants, the garment indicia strip is preferably placed adjacent and substantially parallel to the side seam of the pant leg.

The garment indicia strip can be placed at any point along the side seam at which the garment will be folded. For example, if the pants are to be folded in half for storage or display, the garment indicia strip can be placed at approximately the midpoint of the side seam. If, however, the pants are to be folded in thirds for storage or display, the garment indicia strip can be placed approximately one-third the length of the side seam from the waistband of said pants.

A release liner is affixed to the indicia strips prior to their application to a garment. The release liner prevents the indicia strips from becoming inadvertently affixed prior to their use, and more importantly, the liner allows the indicia strips and release liner to be formed into a continuous length which can be readily rolled for storage and unrolled for use.

BRIEF DESCRIPTION OF THE DRAWINGS

For a more complete understanding of the present invention and for further advantages thereof, reference is now made to the following Description of the Preferred Embodiment taken in conjunction with the accompanying Drawings, in which:

FIG. 1 is a perspective view of the front surface of the indicia strip of the present invention;

FIG. 2 is a perspective view of the rear surface of the indicia strip of the present invention;

FIG. 3 is a perspective view of the garment indicia strip of the present invention in place on an unfolded pair of pants;

FIG. 4 is a perspective view of the garment indicia strip of the present invention on a folded pair of pants; and FIG. 5 is a perspective, partially exploded view of indicia strips of the present invention in place on a continuous roll of release liner.

DESCRIPTION OF THE PREFERRED EMBODIMENTS

Referring to FIGS. 1 and 2, a garment indicia strip of the present invention is generally identified by reference numeral 10. Strip 10 has a front surface 12 and a rear surface 14. Indicia 16 are printed on front surface 12 of strip 10. It has been found to be beneficial to repeatedly print indicia 16 along front surface 12. It is also beneficial that indicia 16 be printed with letters or numerals having a height "h" which is not greater than the width "w" of a folded edge of pants 24, as been seen in FIG. 4. As a result of repeatedly printing indicia 16 along strip 10 and limiting height "h" of indicia 16, indicia 16 are visible and legible whenever strip 10 is folded along its length 18, as depicted best in FIG. 4.

Rear surface 14 of strip 10 has a pressure sensitive adhesive mounted thereon. Any known pressure sensitive adhesive may be used in conjunction with the present invention. However, it has been found to be desirable to use a pressure sensitive adhesive which will not mar the surface structure of and which may be readily removed from the garment or article to which the garment indicia strip is attached. Prior to application of strip 10 to a garment, a release liner 22 is applied to rear surface 14 in order to prevent adhesive 20 from binding to any surface prematurely. Release liner 22 may be constructed of any known material such as, by way of example, bet not by way of limitation, Fasson® CRACK 'N PEEL plus™. In a preferred embodiment, release liner 22 is constructed of a silicon-coated paper material.

In a preferred method for using the garment indicia strip of the present invention, a plurality of strips 10 are attached to a continuous length 28 of release liner 22, as best seen in FIG. 5. Continuous length 28 having strips 10 mounted thereon can be rolled to form roll 30 of strips 10 and release liner 22. Roll 30 facilitates compact and safe storage of strips 10 while also facilitating the dispensing of said strips for use. In a second preferred method, a plurality of strips 10 are attached to form a continuous length of said strips. The continuous length of strips 10 is then releasably adhered to continuous length 28 of release liner. In a second preferred method, a means of detaching strips 10 from one another, such as by perforation, is provided. Strips 10 are individually removed from continuous length 28 of release liner immediately prior to application of strip 10 to the garment as described below.

Although the garment indicia strip of the present invention can be used with any garment or object, the following description of use of the garment indicia strip on a pair of pants will be deemed to describe its use on any other garment or object. Referring to FIGS. 3 and 4, the garment indicia strip 10 of the present invention can be applied to a pair of pants 24 to indicate various features of pants 24. For example, indicia 16 may reflect the waist size and/or inseam length of the pants. Indicia 16 may also indicate style number, size, color, etc. Strip 10 is preferably applied to pants 24 adjacent and substantially parallel to side seam 26 of pants 24. Strip 10 is placed along side seam 26 at a predetermined position such that pants 24 can be folded and stacked with indicia 16 appearing on the outside fold of the pants, thus permitting a customer to readily see the size of each pair of pants in the stack. For example, if pants 24 are to be folded in half for storage or display, strip 10 is adhered to pants 24 at approximately the midpoint of side seam 26. If pants 24 are to be folded in thirds for storage or display, strip 10 is adhered to pants 24 approximately one-third the length of the side seam from waist 34 of pants 24.

Although the present invention has been described with respect to specific preferred embodiments and preferred methods of practice, various changes and modifications may be suggested to one skilled in the art and it is intended that the present invention encompass such changes and modifications as fall within the scope of the appended claims.

What is claimed is:

1. A method of size labeling a garment, comprising:

printing sizing information for said garment repeatedly on a first major surface of a flexible strip of material;

providing a second major surface of said strip of material with a pressure sensitive adhesive material suitable for releasably affixing said flexible strip of material to said garment; and affixing said strip of material onto said garment;

folding said garment such that said strip of material is affixed to an outer surface of said folded garment and such that said strip of material spans a fold of said folded garment, whereby the size of said garment can be readily determined when said garment is displayed in a stack of garments on a store shelf.

2. The method of size labeling of claim 1 further comprising:

mounting said second major surface of said strip of material onto a release liner such that said release liner keeps said adhesive material from contacting other objects prior to affixing said strip of material to said garment; and removing said release liner from said strip of material prior to affixing said strip of material onto said garment.

3. The method of labeling of claim 1 further comprising:

affixing a plurality of said strips of material onto a continuous length of silicon-coated release liner; and removing each of said strips of material from said liner prior to affixing said strip of material onto said garment.

4. The method of labeling of claim 3 further comprising:

rolling said liner and said affixed strips of material into a roll, whereby said roll provides a means for storing and dispensing said flexible strips of material for attachment to said garment.

5. The method of labeling of claim 1 further comprising:

attaching a plurality of said strips of material together to form a continuous length of said strips of material and including means for separating one of said strips of material from another of said strips of material;

affixing said second major surface of each of said attached strips of material onto a continuous length of release liner;

detaching said strips of material from the length of attached strips of material; and removing said strips of material from said liner prior to affixing each of said strips of material to said garment.

6. A sizing label in combination with a garment, said garment being folded creating a fold having a width, said sizing label comprising:

a flexible strip of material having a first major surface and a second major surface, said first major surface having size information for said garment printed repeatedly thereon, said size information being printed with numerals having a height not greater than the width of said fold of said garment to which the label is affixed; and said second major surface having a pressure sensitive adhesive material mounted thereon, said strip of material completely conforming to and being adhesively secured to said garment around said fold, with said size information displayed around said fold such that a consumer can readily determine the size of said folded garment from the size information visible on said strip of material when said folded garment is displayed in a stack of garments.

7. The sizing label in combination with a garment of claim 6 further comprising:

a liner paper releasably attached to said pressure sensitive adhesive material mounted on said second major surface of said strip of material, whereby said strip of material can be removed from said liner paper for attachment of said strip of material to said garment.

* * * * *